US011129408B2

(12) United States Patent
Xiao

(10) Patent No.: US 11,129,408 B2
(45) Date of Patent: Sep. 28, 2021

(54) SUCTION DEVICE

(71) Applicant: SHENZHEN UWELL TECHNOLOGY CO., LTD., Shenzhen (CN)

(72) Inventor: Yucheng Xiao, Shenzhen (CN)

(73) Assignee: SHENZHEN UWELL TECHNOLOGY CO., LTD., Shenzhen (CN)

( * ) Notice: Subject to any disclaimer, the term of this patent is extended or adjusted under 35 U.S.C. 154(b) by 366 days.

(21) Appl. No.: 16/285,255

(22) Filed: Feb. 26, 2019

(65) Prior Publication Data

US 2020/0046022 A1 Feb. 13, 2020

(30) Foreign Application Priority Data

Aug. 13, 2018 (CN) ..... 201821304114.5

(51) Int. Cl.
*A24F 13/00* (2006.01)
*A24F 7/00* (2006.01)

(52) U.S. Cl.
CPC ..... *A24F 7/00* (2013.01)

(58) Field of Classification Search
CPC ..... A24F 47/00
USPC ..... 131/328–329
See application file for complete search history.

(56) References Cited

U.S. PATENT DOCUMENTS 10,104,909 B2 * 10/2018 Han ..... A24F 13/12
10,420,376 B2 * 9/2019 Qiu ..... A24F 40/51

FOREIGN PATENT DOCUMENTS

CN WO 2016/150019 * 9/2016

* cited by examiner

*Primary Examiner* — Phuong K Dinh

(57) ABSTRACT

An electronic cigarette includes a mouthpiece, an atomizer and a battery member connected in turn from top to bottom along an axis direction of the electronic cigarette. An airflow induction switch and a mechanical switch are respectively received in the battery member and independently configured to control the battery member to start the atomizer to heat e-liquid contained in the atomizer, and an atomization core is vertically arranged in the atomizer. The present disclosure is provided with two independent switch modes, thereby when one switch mode is failed, the other switch mode can be used to power and heat heating elements within the atomizer to heat and atomize the e-liquid to ensure a reliable and normal usage of the product.

9 Claims, 12 Drawing Sheets

SUCTION DEVICE

BACKGROUND

1. Technical Field

The present disclosure generally relates to electronic cigarettes field, and especially relates to an electronic cigarette.

2. Description of Related Art

Electronic cigarettes are more and more popular. A conventional suction device generally includes a mouthpiece, an atomizer and a battery. Such kind of suction device is activated only via a single switch mode, such as by an airflow induction switch to activate heating, thereby the suction device can't work normally when this kind of switch is disabled.

SUMMARY

The technical problems to be solved: in view of the shortcomings of the related art, the present disclosure relates to an electronic cigarette which can provide with two independent switch modes so that when one switch mode is failed, the other switch mode can be used to heat and atomize the e-liquid by powering and heating a heating element within its atomizer to further ensure a reliable and not vial usage of the product.

The technical solution adopted for solving technical problems of the present disclosure is:

An electronic cigarette includes a mouthpiece, an atomizer and a battery member connected in turn from top to bottom along an axis direction of the electronic cigarette. An airflow induction switch and a mechanical switch are respectively received in the battery member and independently configured for controlling the battery member to start the atomizer to heat the e-liquid contained in the atomizer.

Wherein the battery member includes a casing, a battery frame, a battery and a PCB respectively installed in the casing, one end of the casing sleeved on the atomizer and the battery frame connected to the atomizer, the battery electrically connected with the PCB; an end surface of the battery frame which is connected to the atomizer includes an inlet connected to the airflow induction switch sealed in the battery frame, the mechanical switch arranged on the battery frame and exposed outside of the casing; both the airflow induction switch and the mechanical switch electrically connected to the PCB, and the atomizer including a housing and an atomization core received in the housing and vertically arranged therein.

Wherein the battery frame includes a first chamber and a second chamber connected to the first chamber for receiving the battery therein, the airflow induction switch, the PCB and a silicone ring all received in the first chamber, the silicone ring installed on the airflow induction switch, with one end of the silicone ring communicating with the inlet, and a sealing cover arranged on an opening of the first chamber for sealing the first chamber.

Wherein the first chamber includes a first locking slot formed on a wall therein and the sealing cover includes a first hook snapped into the first locking slot.

Wherein an annular sealing groove is arranged on the periphery of their connection between the battery frame and the atomizer, and a sealing ring is arranged in the sealing groove.

Wherein the mechanical switch includes a pressing portion, a pair of second hooks arranged on two opposite ends of the pressing portion, and a contacting portion arranged on the back of the pressing portion and located between the pair of second hooks; the battery frame further including a mounting handle formed on an outer surface thereof for installing the mechanical switch, a root of the mounting handle connected to the battery frame, two portions of the mounting handle and the outer surface of the battery frame hollowed-out to form a second locking slot for engaging with the second hook, and a blind hole formed on a free end of the mounting handle; the PCB including a contacting circuit aligned with the blind hole, and the contacting portion snapped into the blind hole and in contact with the contacting circuit of the PCB.

Wherein the atomizer includes an atomization shell connected to a low end of the mouthpiece and partially inserted into the casing, and a pair of lathy posts formed on two ends of the outer wall of the atomization shell along the axis direction of the suction device; a pair of first U-shaped gaps respectively arranged on two sides of their connection, joint between the casing and the atomizer for partially engaging with corresponding lathy posts.

Wherein a magnetic member is arranged on the connection between the casing and the atomizer for connecting the atomizer with the battery member, the magnetic member including a first magnetic portion formed on an end portion of the atomizer and a second magnetic portion arranged on an end surface of the battery frame and located on two sides of the inlet to couple with the first magnetic portion.

Wherein a pair of second U-shaped gaps is respectively arranged on two ends of the lower end of the mouthpiece which is connected to the atomizer along the axis direction of the suction device, a plurality of recesses arranged on an inner wall of the mouthpiece and a plurality of protrusions arranged on the outer wall of the atomization shell corresponding to the plurality of recesses, the atomization shell partially inserted into the mouthpiece, the lathy post of the atomization shell partially inserted into the second U-shaped gap and the protrusion of the atomization shell snapped into the recess of the mouthpiece.

Wherein a plurality of posts is arranged on the inner wall of the mouthpiece and a sealing silicone is arranged between the plurality of posts for sealing the connection between the inner wall of the mouthpiece and the atomizer.

The present disclosure provides the advantages as below.

The structure of the present disclosure is provided with two independent switch modes so that when one switch mode is failed, the other switch mode can be used to heat and atomize the e-liquid by powering and heating a heating element within its atomizer to further ensure a reliable and normal usage of the product.

BRIEF DESCRIPTION OF THE DRAWINGS

Many aspects of the embodiments can be better understood with reference to the following drawings. The components in the drawings are not necessarily drawn to scale, the emphasis instead being placed upon clearly illustrating the principles of the embodiments. Moreover, in the drawings, like reference numerals designate corresponding parts throughout the several views.

DETAILED DESCRIPTION

Figure 1:
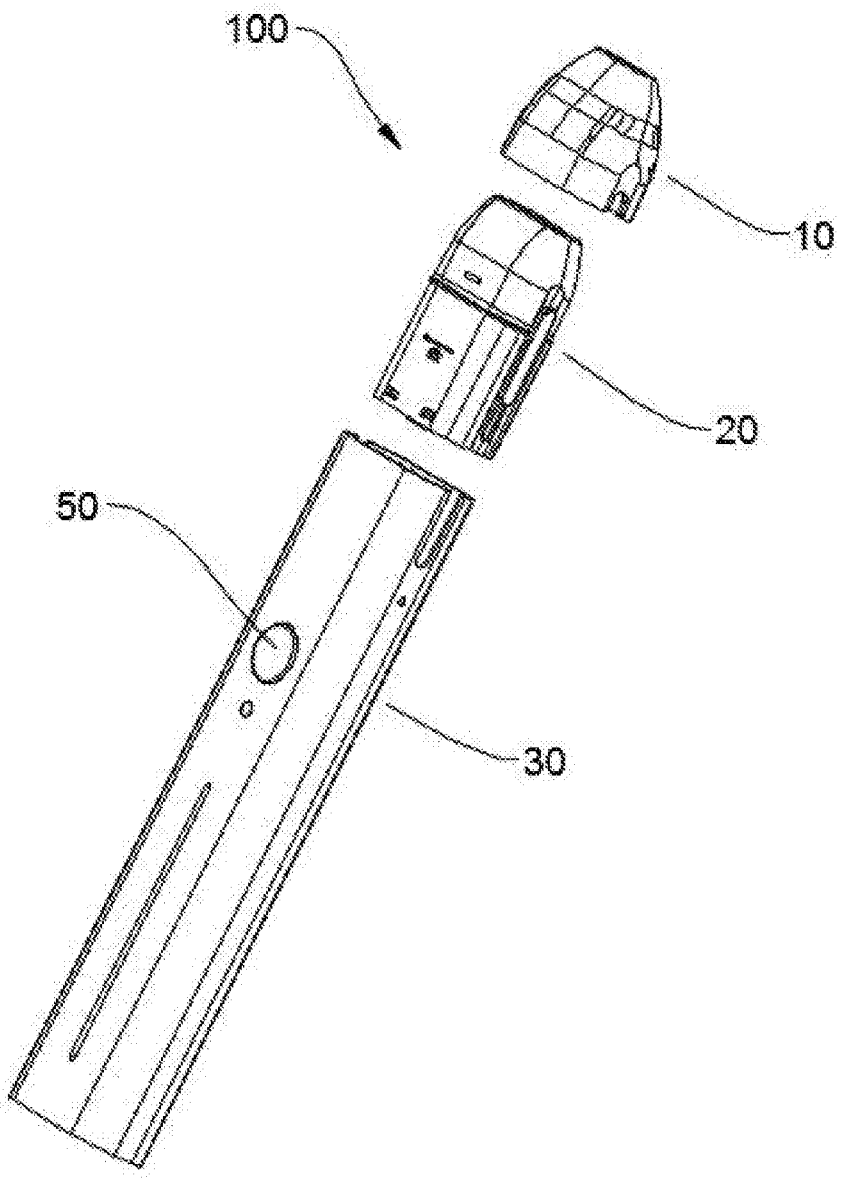
FIG. 1 is an exploded, schematic view of an electronic cigarette in accordance with an exemplary embodiment.

The disclosure is illustrated by way of example and not by way of limitation in the figures of the accompanying drawings, in which like reference numerals indicate similar elements.

Figure 2:
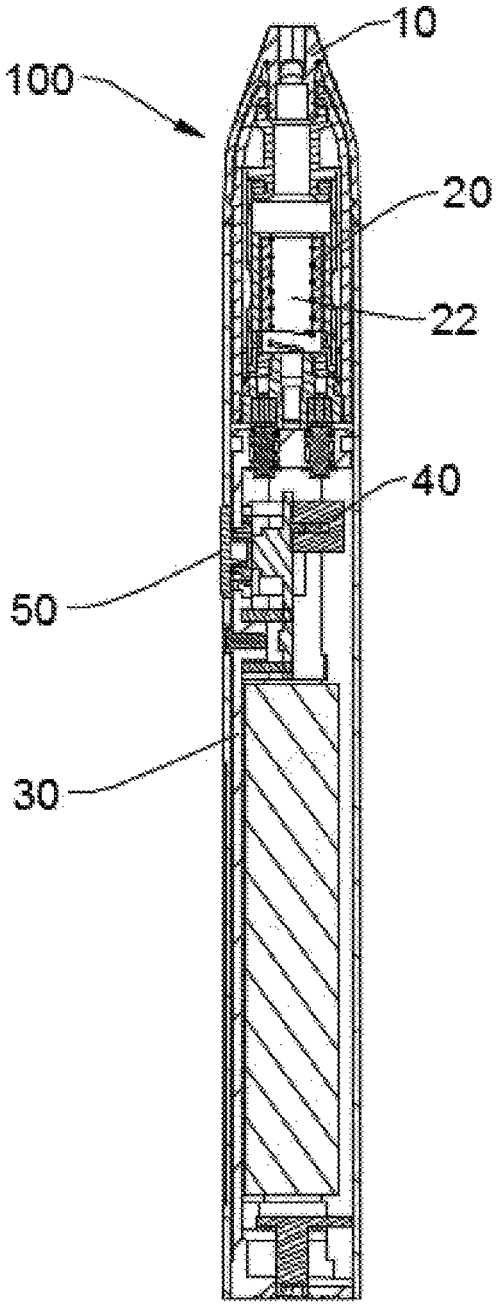
FIG. 2 is a cross-sectional view of the electronic cigarette of FIG. 1.
Figure 3:
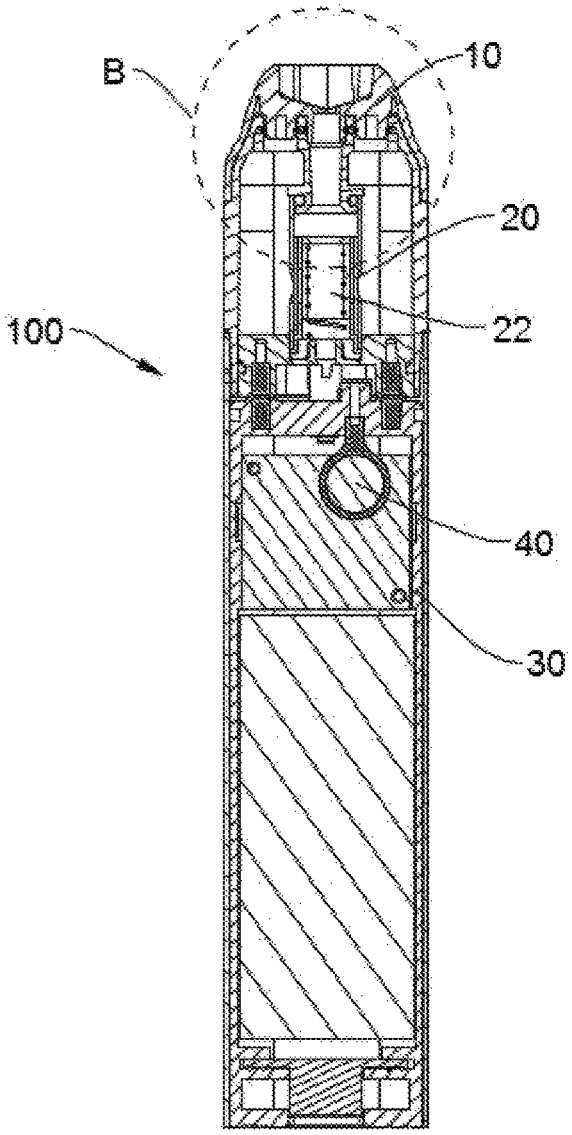
FIG. 3 is similar to FIG. 2, but shown the electronic cigarette of FIG. 1 from another view.
Figure 4:
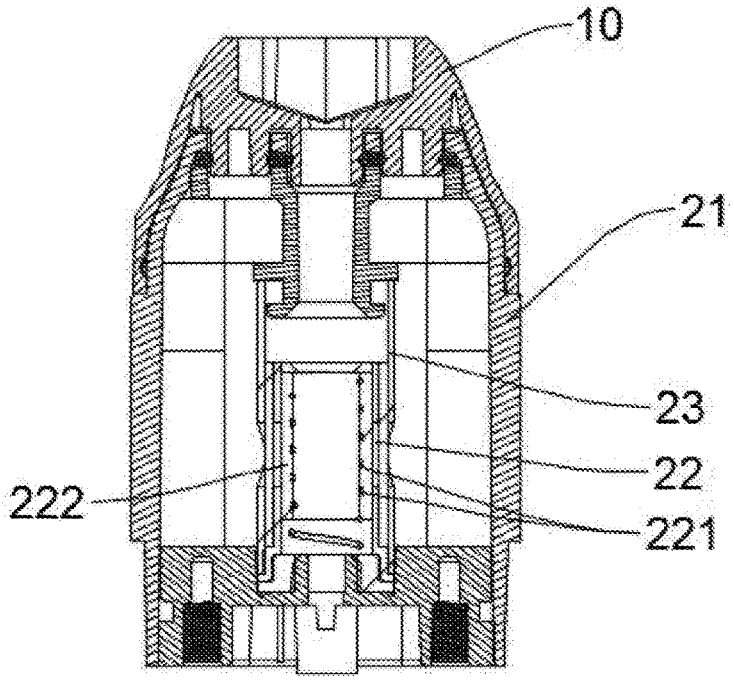
FIG. 4 is a cross-sectional view of a mouthpiece and an atomizer of the electronic cigarette of FIG. 1.

Referring to FIGS. 1-3, the electronic cigarette 100 in accordance with an exemplary embodiment of the present disclosure includes a mouthpiece 10, an atomizer 20 and a battery member 30 connected in turn from top to bottom along an axis direction of the electronic cigarette 100. An airflow induction switch 40 and a mechanical switch 50 are respectively received in the battery member 30 and independently configured to control the battery member 30 to start the atomizer 20 heating the c-liquid contained in the atomizer 20. The airflow induction switch 40 is configured to start heating, the atomizer 20 through its trigger circuit induced by air flow, and the mechanical switch 50 is configured to start heating the atomizer 20 by pressing its trigger circuit. Referring to FIG. 4, the atomizer 20 includes a housing 23 and an atomization core 22 vertically arranged therein and received in the housing 23. In this way, gas can be discharged more smoothly during the suction process. The atomization core 22 further includes a heating element 221 and an organic cotton 222 formed thereon. The battery member 30 includes a battery 33 received therein, and a connecting electrode is arranged at the connection between the battery member 30 and the atomizer 20 to conduct a heating circuit connected the battery 33 with the heating element 221.

Figure 5:
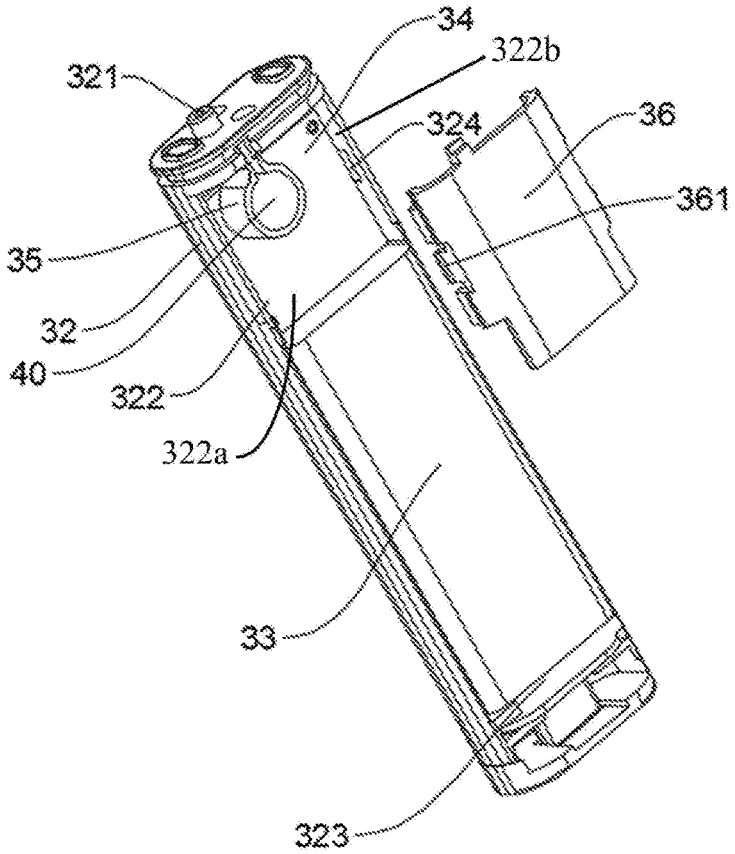
FIG. 5 is a partial exploded, schematic view of a battery member of the electronic cigarette of FIG. 1, but not shown a casing of the battery member thereon.
Figure 6:
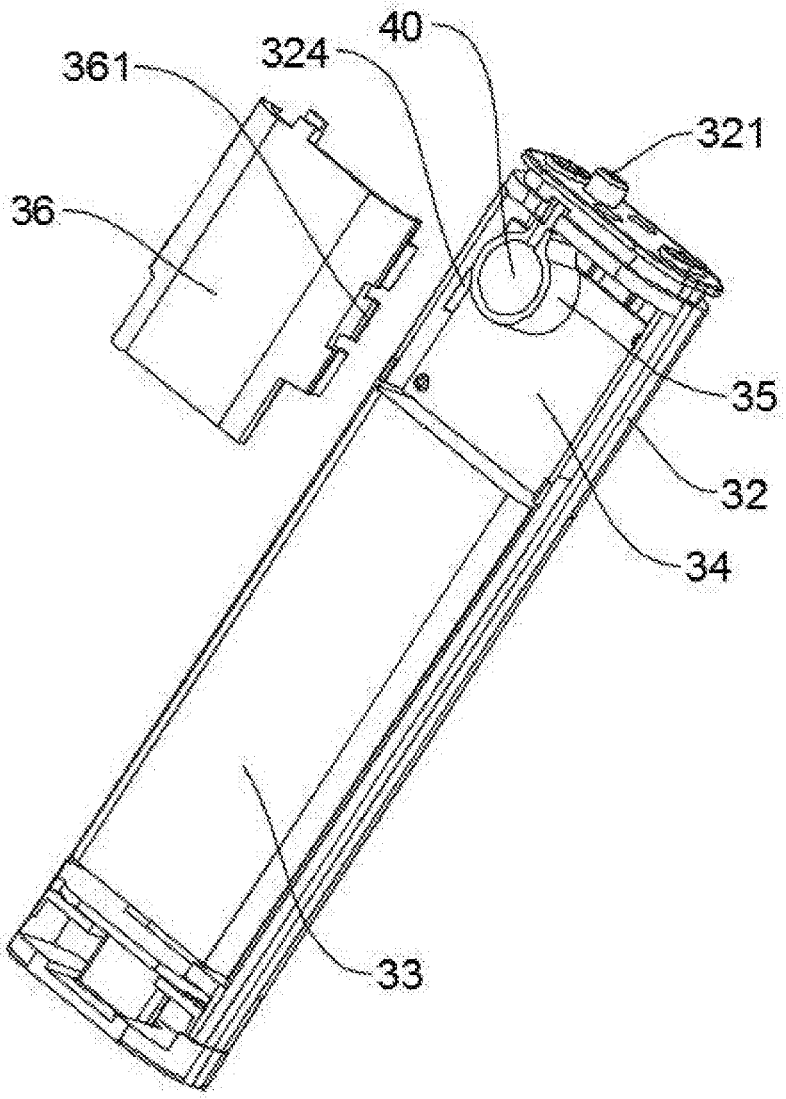
FIG. 6 is similar to FIG. 5, but shown from another view.

Specifically, referring to FIG. 5 and FIG. 6, the battery member 30 includes a casing 31, a battery frame 32, the battery 33 and a PCB 34 respectively installed in the casing 31. One end of the casing 31 is sleeved on the atomizer 20 and the battery frame 32 is connected to the atomizer 20. The battery 33 is electrically connected with the PCB 34. An end surface 32*c* of the battery frame 32 which is connected to the atomizer 20 includes an inlet 321 connected to the airflow induction switch 40 sealed in the battery frame 32, and the mechanical switch 50 is arranged on the battery frame 32 and exposed outside of the casing 31. Both the airflow induction switch 40 and the mechanical switch 50 are electrically connected to the PCB 34. As the air flow induction switch 40 and the mechanical switch 50 are electrically connected with the PCB 34, respectively, and the air flow induction switch 40 is connected, with the inlet 321, when the mouthpiece 10 is used, the negative pressure airflow in the atomizer 20 enters the airflow induction switch 40 through the inlet 321. At this time, the airflow induction switch 40 can sense the flow of the negative pressure airflow to trigger the circuit of the PCB 34 and then the heating circuit of the heating element 221 is triggered to heat the heating element 221 to start atomizing its e-liquid in the atomizer 20. Or, when the mechanical switch 50 is pressed to trigger the circuit of the PCB 34, and then the heating circuit of the heating, element 221 is triggered to heat the heating element 221 to start atomizing its e-liquid in the atomizer 20. In coordination with user's suction action, the electronic cigarette 100 begins to atomize the e-liquid. In sum, the electronic cigarette 100 of the present disclosure can provide with two independent switch modes. In this way, when one switch mode is failed, the other switch mode can be used to heat and atomize the e-liquid by powering and heating the heating element 221 in the atomizer 20 to further ensure a reliable and normal usage of the product.

It can be understood that the two switch structures of the present disclosure can be interlocked so that the two switch modes don't interfere with each other.

In an exemplary embodiment of the present disclosure, the battery frame 32 includes a first chamber 322 and a second chamber 323 connected to the first chamber 322 for receiving the battery 33 therein. All the airflow induction switch 40, the PCB 34 and a silicone ring 35 are received in the first chamber 322. The silicone ring 35 is installed on the airflow induction switch 40, with one end of the silicone ring 35 communicating with the inlet 321, and a sealing cover 36 is arranged on an opening 322*a* of the first chamber 322 for sealing the first chamber 322. The silicone ring 35 is configured to install the airflow induction switch 40 and connect to the inlet 321, which is convenient for manufacturing and minimizing the product cost. Furthermore, the sealing cover 36 is configured to seal the first chamber 322 so that the airflow induction switch 40 within the first chamber 322 can work normally.

Specifically, the first chamber 322 includes a first locking slot 324 formed on a wall 322*b* therein and the sealing cover 36 includes a first hook 361 snapped into the first locking slot 324. The setting of the first hook 361 and the first locking slot 324 can facilitate the installation of the sealing cover 36 and the battery frame 32.

Figure 7:
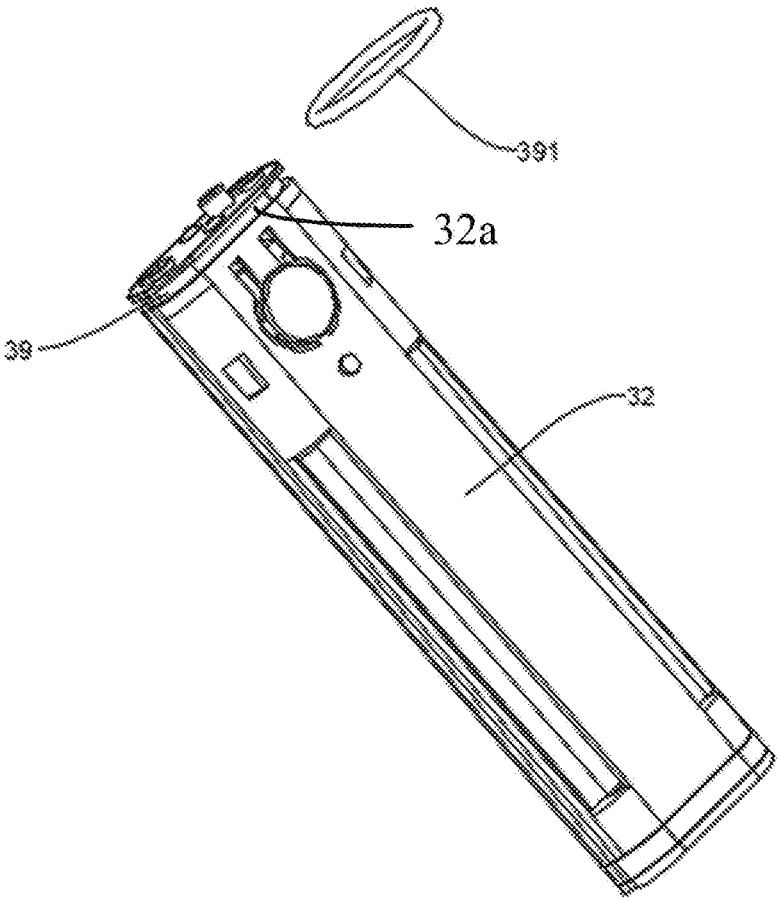
FIG. 7 is an exploded, schematic view of a battery frame and a sealing ring of the battery member of the electronic cigarette of FIG. 5.
Figure 8:
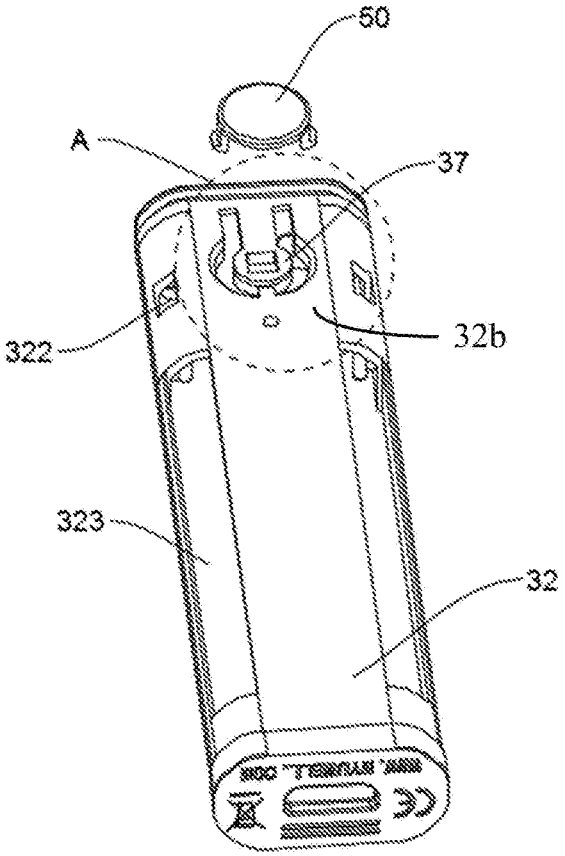
FIG. 8 is an exploded, schematic view of the battery frame and a mechanical switch of the battery member of the electronic cigarette of FIG. 5.
Figure 9:
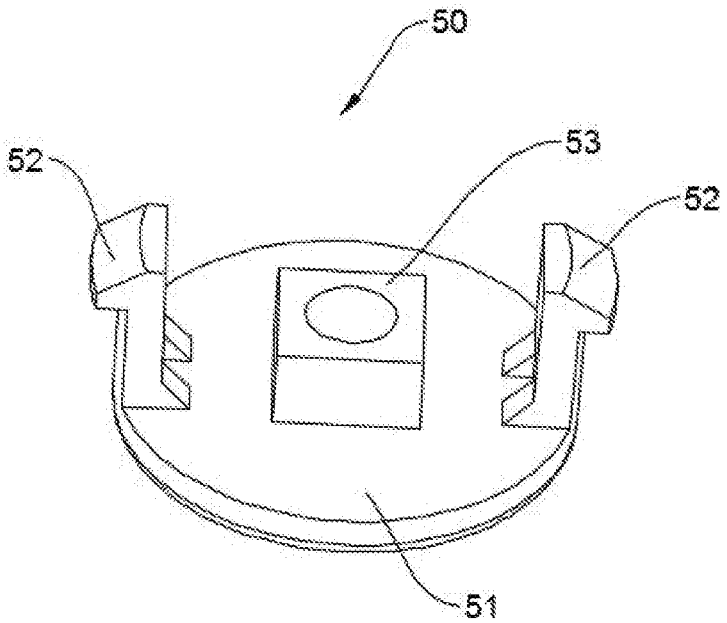
FIG. 9 is a schematic view of the mechanical switch of the electronic cigarette of FIG. 5.
Figure 10:
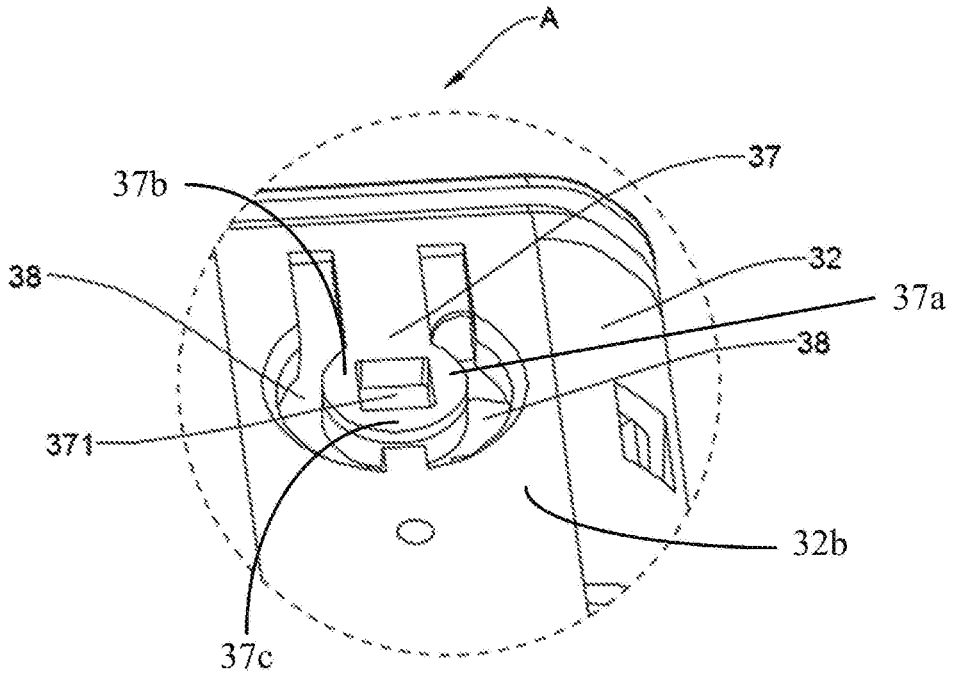
FIG. 10 is an enlarged schematic view of Circle A of FIG. 8.
Figure 11:
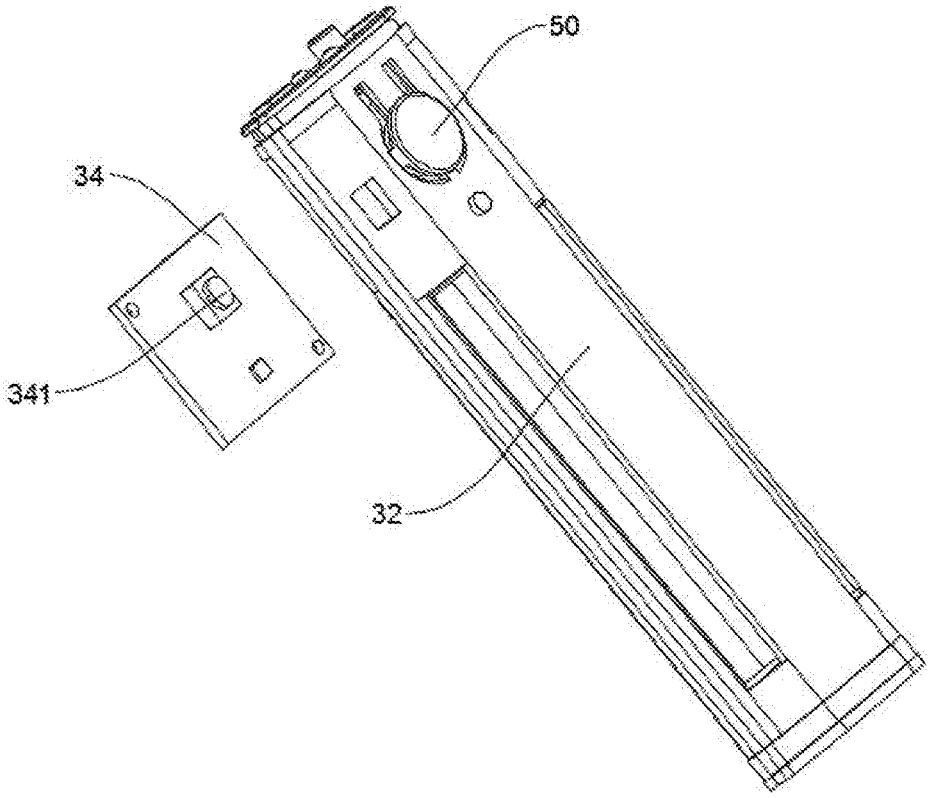
FIG. 11 is an exploded, schematic view of the battery frame and a PCB of the electronic cigarette of FIG. 1.

Furthermore, referring to FIG. 7, an annular sealing groove 39 is arranged on the periphery of their connection 32*a* between the battery frame 32 and the atomizer 20, and a sealing ring 391 is arranged in the sealing groove 39. Such structure of the sealing ring 391 can further enhance the sealing effect of the first chamber 322 to ensure the reliability of the airflow induction switch 40.

Referring to FIGS. 8-11 the mechanical switch 50 includes a pressing portion 51, a pair of second hooks 52 arranged on two opposite ends of the pressing portion 51, and a contacting portion 53 arranged on the back of the pressing portion 51 and located between the pair of second hooks 52. The battery frame 32 further includes a mounting handle 37 formed on an outer surface 32*b* thereof for installing the mechanical switch 50. A root 37*a* of the mounting handle 37 is connected to the battery frame 32, two portions 37*b* of the mounting handle 37 and the outer surface 32*b* of the battery frame 32 are hollowed-out to form a second locking slot 38 for engaging with the second hook 52, and a blind hole 371 formed on a free end 37*c* of the mounting handle 37. The PCB 34 includes a contacting circuit 341 aligned with the blind hole 371, and the contacting portion 53 of the mechanical switch 50 is snapped into the blind hole 371 and then in contact with the contacting circuit 341 of the PCB 34. The mechanical switch 50 is installed on the battery frame 32 by the second hook 52 engaging with the second locking slot 38. In an exemplary embodiment of the present disclosure, the blind hole 371 is a square structure. The combination of the blind hole 371 and the contacting portion 53 can limit the rotation of the mechanical switch 50 relative to the battery frame 32.

Figure 12:
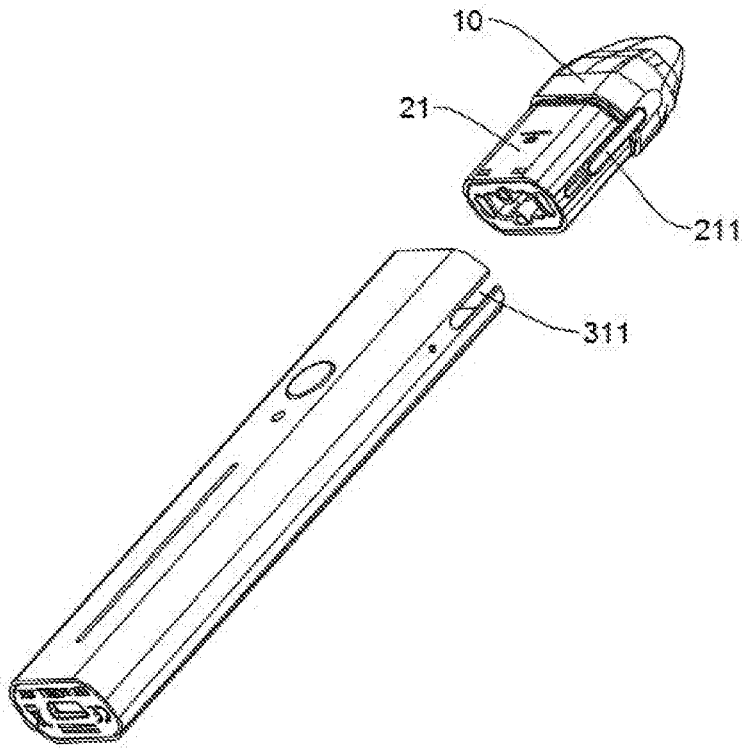
FIG. 12 is an exploded, schematic view of the battery member and the atomizer of the electronic cigarette of FIG. 1.
Figure 13:
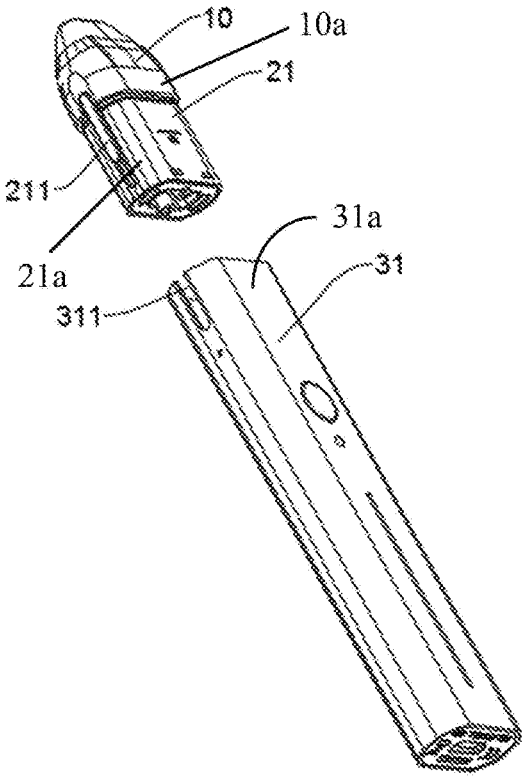
FIG. 13 is similar to FIG. 12, but shown from another view.

Referring to FIG. 12 and FIG. 13, the atomizer 20 includes an atomization shell 21 connected to a lower end 10*a* of the mouthpiece 10 and partially inserted into the casing 31, and a pair of lathy posts 211 formed on two ends of the outer wall 21*a* of the atomization shell 21 along the axis direction of the suction device 100. A pair of first U-shaped gaps 311 is respectively arranged on two sides of their connection joint 31*a* between the casing 31 and the atomizer 20 for partially engaging with corresponding lathy posts 211. The atomization shell 21 is inserted into the casing 31 to facilitate the assembly of the atomizer 20 and the battery member 30. Meanwhile, the connection between the atomizer 20 and the battery member 30 is limited by the lathy post 211 snapping into the first U-shaped gap 311, thereby it is convenient for their location and installation.

Figure 14:
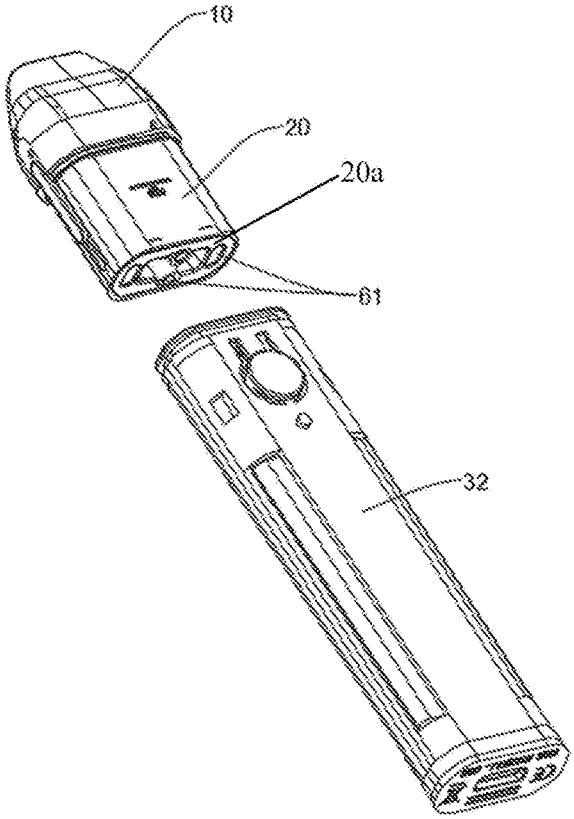
FIG. 14 is an exploded, schematic section view of the battery frame and the atomizer of the electronic cigarette of FIG. 1.
Figure 15:
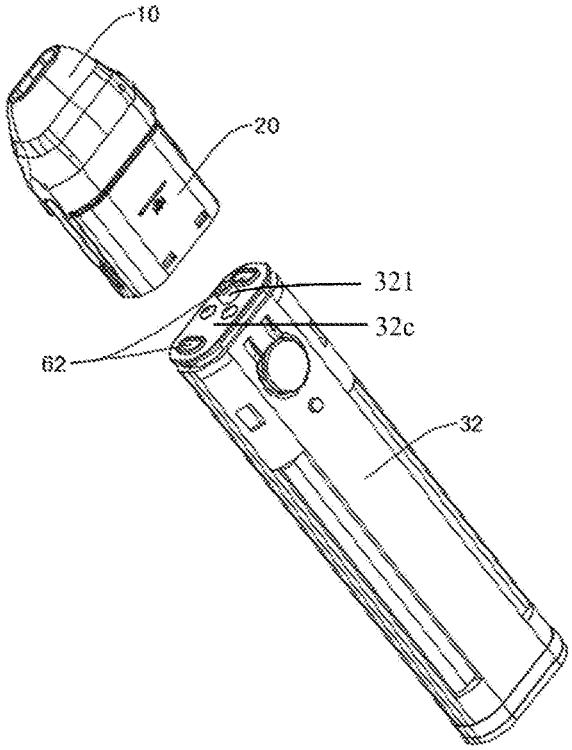
FIG. 15 is similar to FIG. 14, but shown from another view.

Preferably, in an exemplary embodiment of the present disclosure, a magnetic member is arranged on their connection 32*a* between the casing 31 and the atomizer 20 for connecting the atomizer 20 with the battery member 30. Referring to FIG. 14 and FIG. 15, the magnetic member includes a first magnetic portion 61 formed, on an end portion 20*a* of the atomizer 20 and a second magnetic portion 62 arranged on an end surface 32*c* of the battery frame 32 and located on two sides of the inlet 321. The first magnetic portion 61 is coupled with the second magnetic portion 62. The magnetic member not only can tighten the connection between the atomizer 20 and the battery member 30, but also can facilitate the installation and disassembly, with simple structure and low-cost.

Figure 16:
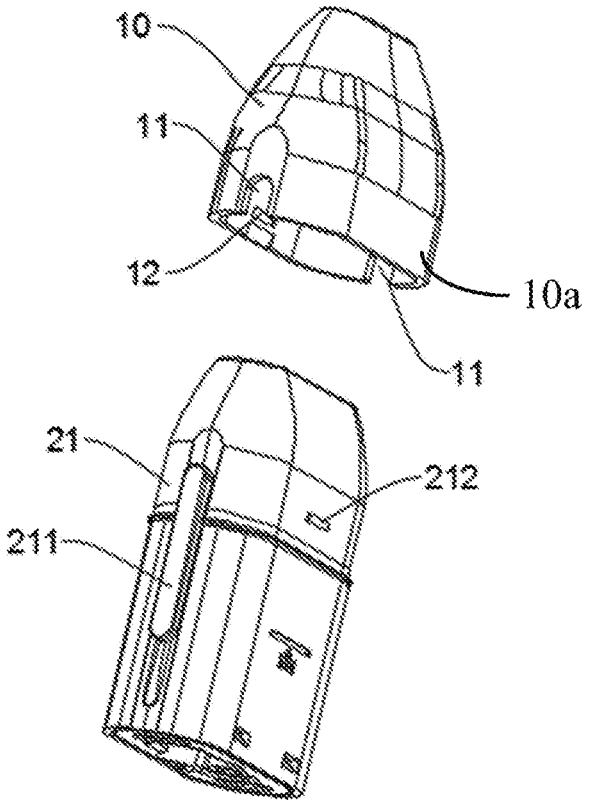
FIG. 16 is an exploded, schematic view of the mouthpiece and the atomizer of the electronic cigarette of FIG. 1.
Figure 17:
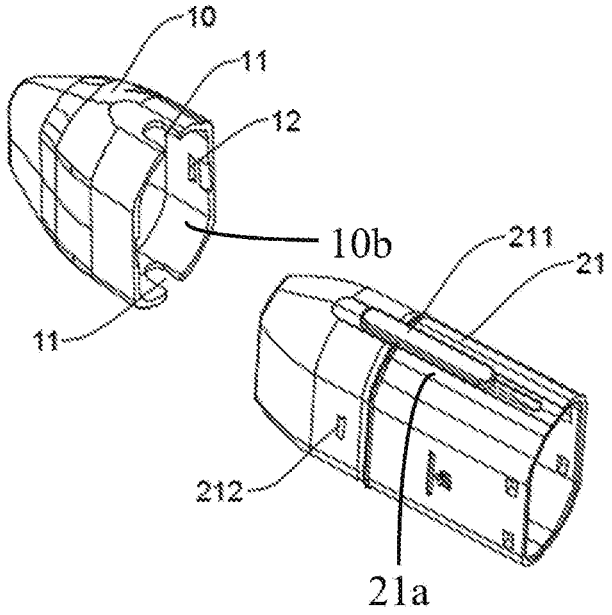
FIG. 17 is similar to FIG. 14, but shown from another view.

Referring to FIG. 16 and FIG. 17, a pair of second U-shaped gaps 11 is respectively arranged on two ends of the lower end 10*a* of the mouthpiece 10 which is connected to the atomizer 20 along the axis direction of the electronic cigarette 100, a plurality of recesses 12 arranged on an inner wall 10*b* of the mouthpiece 10 and a plurality of protrusions 212 arranged on the outer wall 21*a* of the atomization shell 21 corresponding to the plurality of recesses 12. The atomization shell 21 is partially inserted into the mouthpiece 10, and the lathy post 211 of the atomization shell 21 is partially inserted into the second U-shaped gap 11 and the protrusion 212 of the atomization shell 21 is snapped into the recess 12 of the mouthpiece 10.

In this way, the mouthpiece 10 is pluggably connected with the atomizer 20 to facilitate operations such as adding e-liquid from the upper end of the atomizer 20. The mouthpiece 10 is removed from the upper end of the atomizer 20 when needing to add the e-liquid. The rotation between the mouthpiece 10 and the atomizer 20 can be limited by connecting the lathy post 211 and the second U-shaped gap 11 to facilitate the installation and disassembly between them. In this way, two ends of the atomizer 20 are respectively inserted into the mouthpiece 10 and the battery member 30 so as to reduce the space occupied by the atomizer 20 and make use of the overall aesthetic effect of the product.

In an exemplary embodiment of the present disclosure, the atomization shell 21 is made of transparent material for observing the e-liquid balance in the atomizer 20 so that the e-liquid can be refueled in time when it is insufficient.

Figure 18:
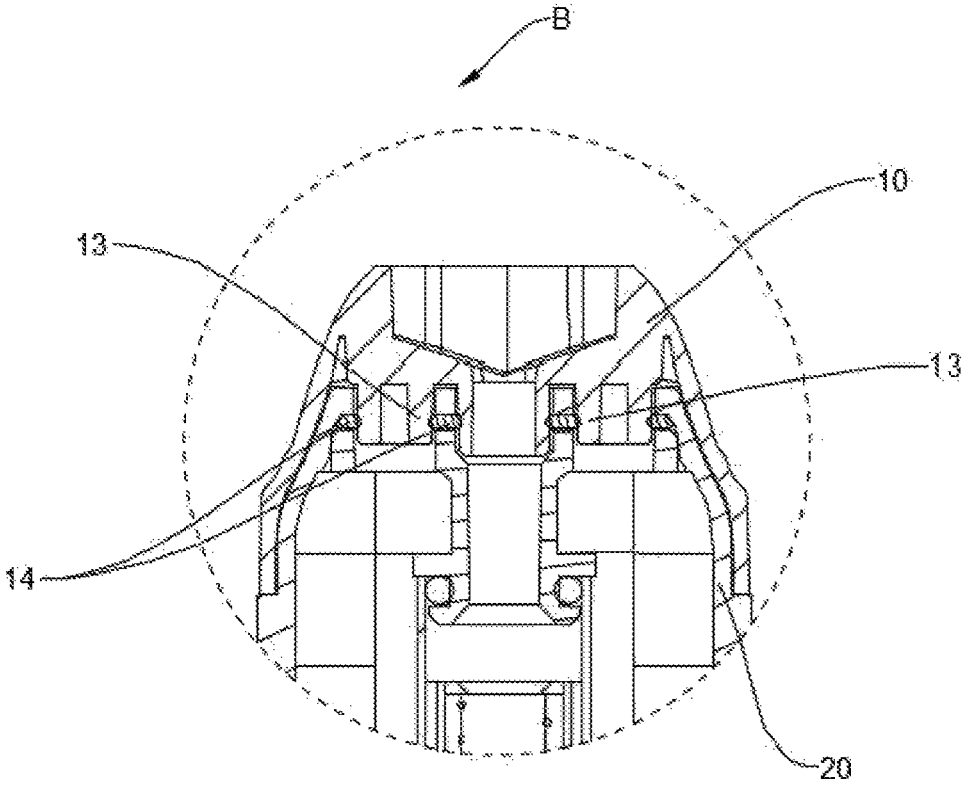
FIG. 18 is an enlarged schematic view of Circle B of FIG. 3.

Preferably, referring to FIG. 18, a plurality of posts 13 is arranged on the inner wall 10*b* of the mouthpiece 10 and a sealing silicone 14 is arranged between the plurality of posts 13 for sealing the connection between the inner wall 10*b* of the mouthpiece 10 and the atomizer 20. The sealing silicone 14 can tighten the installation between the mouthpiece 10 and the atomizer 20 on the one hand, and seal the connection between them on the other hand, to prevent the e-liquid car smoke leakage from the connection to affect the use of the product.

The electronic cigarette 100 of the present disclosure is provided with the battery member 30 which has two independent switch modes of an airflow induction switch 40 and a mechanical switch 50. When one switch mode is failed, the other switch mode can be used to heat and atomize the e-liquid by powering and heating the heating element in the atomizer 20 to further ensure a reliable and normal usage of the product.

Although the features and elements of the present disclosure are described as embodiments in particular combinations, each feature or element can be used alone or in other various combinations within the principles of the present disclosure to the full extent indicated by the broad general meaning of the terms in which the appended claims are expressed.

What is claimed is:

1. An electronic cigarette comprising:

a mouthpiece, an atomizer and a battery member connected in turn from top to bottom along an axis direction of the electronic cigarette; and wherein an airflow induction switch and a mechanical switch are respectively received in the battery member and independently configured for controlling the battery member to start the atomizer to heat the e-liquid contained in the atomizer; and wherein the battery member comprises a casing, a battery frame, a battery and a PCB respectively installed in the casing, one end of the casing sleeved on the atomizer and the battery frame connected to the atomizer, the battery electrically connected with the PCB; and wherein an end surface of the battery frame which is connected to the atomizer comprises an inlet connected to the airflow induction switch sealed in the battery frame, the mechanical switch arranged on the battery frame and exposed outside of the casing; both the airflow induction switch and the mechanical switch electrically connected to the PCB, and the atomizer comprising a housing and an atomization core received in the housing and vertically arranged therein.

2. The electronic cigarette as claimed in claim 1, wherein the battery frame comprises a first chamber and a second chamber connected to the first chamber and receiving the battery therein, the airflow induction switch, the PCB and a silicone ring all received in the first chamber, the silicone ring installed on the airflow induction switch, with one end of the silicone ring communicating with the inlet, and a sealing cover arranged on an opening of the first chamber for sealing the first chamber.

3. The electronic cigarette as claimed in claim 2, wherein the first chamber comprises a first locking slot formed on a wall therein and the sealing cover comprises a first hook snapped into the first locking slot.

4. The electronic cigarette as claimed in claim 3, wherein an annular sealing groove is arranged on the periphery of their connection between the battery frame and the atomizer, and a sealing ring is arranged in the sealing groove.

5. The electronic cigarette as claimed in claim 1, wherein the mechanical switch comprises a pressing portion, a pair of second hooks arranged on two opposite ends of the pressing portion, and a contacting portion arranged on the back of the pressing portion and located between the pair of second hooks; the battery frame further comprising a mounting handle formed on an outer surface thereof for installing the mechanical switch, a root of the mounting handle connected to the battery frame, two portions of the mounting handle and the outer surface of the battery frame hollowed-out to form a second locking slot for engaging with the second hook, and a blind hole formed on a free end of the mounting handle; the PCB comprising a contacting circuit aligned with the blind hole, and the contacting portion snapped into the blind hole and then in contact with the contacting circuit of the PCB.

6. The electronic cigarette as claimed in claim 1, wherein the atomizer comprises an atomization shell connected to a low end of the mouthpiece and partially inserted into the casing, and a pair of lathy posts formed on two ends of the outer wall of the atomization shell along the axis direction of the suction device; a pair of first U-shaped gaps respectively arranged on two sides of their connection joint between the casing and the atomizer for partially engaging with corresponding lathy posts.

7. The electronic cigarette as claimed in claim 1, wherein a magnetic member is arranged on the connection between the casing and the atomizer for connecting the atomizer with the battery member, the magnetic member comprising a first magnetic portion formed on an end portion of the atomizer and a second magnetic portion arranged on an end surface of the battery frame and located on two sides of the inlet to couple with the first magnetic portion.

8. The electronic cigarette as claimed in claim 6, wherein a pair of second U-shaped gaps is respectively arranged on two ends of the lower end of the mouthpiece which is connected to the atomizer along the axis direction of the suction device, a plurality of recesses arranged on an inner wall of the mouthpiece and a plurality of protrusions arranged on the outer wall of the atomization shell corresponding to the plurality of recesses, the atomization shell partially inserted into the mouthpiece, the lathy post of the atomization shell partially inserted into the second U-shaped gap and the protrusion of the atomization shell snapped into the recess of the mouthpiece.

9. The electronic cigarette as claimed in claim 8, wherein a plurality of posts is arranged on the inner wall of the mouthpiece and a sealing silicone is arranged between the plurality of posts for sealing the connection between the inner wall of the mouthpiece and the atomizer.

* * * * *